US005224701A

United States Patent [19]

Sciarrillo et al.

[11] Patent Number: 5,224,701

[45] Date of Patent: Jul. 6, 1993

[54] FOOTBALL LAUNCHING APPARATUS

[76] Inventors: Gerald Sciarrillo, 2616 Aein Rd., Orlando, Fla. 32767; Michael G. Woolford, 233 Hill St., Casselberry, Fla. 32707

[21] Appl. No.: 934,558

[22] Filed: Aug. 24, 1992

[51] Int. Cl.[5] ..... A63B 69/40

[52] U.S. Cl. ..... 273/55 R; 124/71; 124/81; 124/56

[58] Field of Search ..... 273/55 R; 124/55, 56, 124/60, 63, 71, 41 C, 81

[56] References Cited

U.S. PATENT DOCUMENTS

| | | | |
|---|---|---|---|
| 3,288,127 | 11/1966 | Bullock | 124/81 |
| 3,926,170 | 12/1975 | Dixon | 273/55 R |
| 3,951,125 | 4/1976 | Dixon | 273/55 R |
| 3,977,386 | 8/1976 | Meyer | 273/55 R |
| 4,261,319 | 4/1981 | Dixon | 273/55 R |
| 4,596,230 | 6/1986 | Griffith | 273/55 R |

OTHER PUBLICATIONS

Washington Post, Jul. 11, 1973.

*Primary Examiner*—Theatrice Brown

*Attorney, Agent, or Firm*—James H. Beusse

[57] ABSTRACT

Apparatus for launching a football on a predetermined trajectory comprises a receptacle for holding a football in an axial alignment such that each end of the football is substantially aligned on an initial arc of a predetermined trajectory. The receptacle is coupled to a piston of a pneumatic cylinder for rapidly accelerating the receptacle along the predetermined trajectory for a preselected relatively small distance from a loading point to a release point. A threaded shaft is positioned between the piston and receptacle and driven through a nut for effecting a relatively rapid spin of the receptacle about an axis coincidental with the initial arc of the trajectory during acceleration over the relatively small distance. The football is released from the receptacle at the release point by suddenly stopping movement of the receptacle.

9 Claims, 1 Drawing Sheet

FOOTBALL LAUNCHING APPARATUS

BACKGROUND OF THE INVENTION

The present invention relates to ball throwing apparatus and more particularly, to apparatus for launching a football with a spiral flight pattern.

Ball launching or throwing machines for throwing baseballs or tennis balls are well known in the art. Typically, these machines utilize a rotating arm having a cupped shape receptacle on the end adapted for receiving a ball and then for rapidly accelerating the ball on a predefined trajectory by rotating the arm at a high velocity. The ball is released from the cup by decelerating the rotating arm rapidly so that the tangential acceleration of the arm is transferred to the ball causing it to accelerate away from the machine.

Because of the unique shape of the American football, the machines commonly used for accelerating baseballs or tennis balls are not readily adaptable to throwing of a football. In particular, the shape of a football is more designed for throwing with the longitudinal axis of the football along the trajectory path and with the football having a spin in a plane normal to the path. This flight pattern is peculiar to a football due to its elongated shape with bluntly pointed ends. Although it would be desirable to provide a machine which is capable of throwing a football in this particular pattern since this pattern provides the accuracy and distance desired in launching a football, such machines have heretofore been unknown.

SUMMARY OF THE INVENTION

It is an object of the present invention to provide a football throwing apparatus which is capable of launching a football on a predetermined trajectory with accuracy and control of the distance thrown. In accordance with a preferred embodiment of the present invention, there is provided a football launching machine comprising a cupped shaped mechanism for receiving an end of a football and for holding the football in a launching position. The cupped shape mechanism is attached to a shaft having at least one spiral thread formed around an outside circumference of the shaft. The shaft fits within a nut-like mechanism having radially inner studs which fit between the spaces on the shaft formed by the spiral threads. A second end of the shaft is connected to a pneumatic or hydraulic cylinder which, when actuated, causes the shaft to move rapidly through the nut thereby affecting a spinning motion of the shaft as the shaft accelerates under the force from the pneumatic cylinder. The spinning of the shaft is transferred to the attached football holding cup and thus to the football. The machine is so designed that the cylinder extends out a predetermined distance until the shaft is abruptly stopped while the momentum imparted to the football causes it to continue on its prealigned trajectory.

The machine includes adjustment means for controlling the angle at which the football is launched both with respect to a horizontal plane and also with respect to a vertical axis at the base of the machine. More particularly, the trajectory of the football is controlled by adjusting the angle at which the shaft is accelerated through the nut and the direction with respect to a vertical axis is controlled by changing the position of the machine. The machine may be mounted on a wheeled truck allowing it to be moved to different locations and also facilitating changing of the direction in which the football is launched from the machine. The trajectory is made adjustable by pivotably mounting the shaft and pneumatic cylinder such that the football holding end may be raised or lowered to control the angle of the trajectory. In the case of a pneumatic cylinder, the machine may include an air pump coupled to the pneumatic cylinder with a control valve positioned in an air line between the pump and the cylinder for applying air to the cylinder and actuating the machine.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
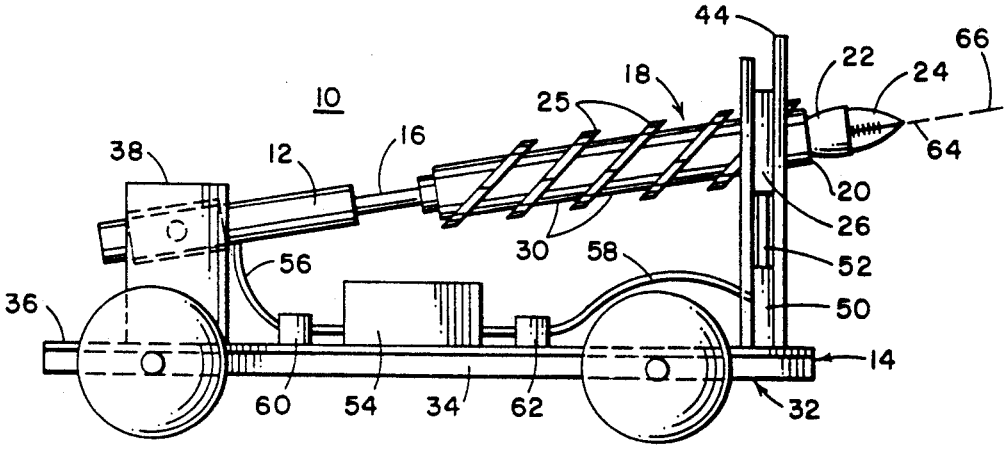
FIG. 1 is a planar view of one form of football launching apparatus in accordance with the present invention.

Referring now to FIG. 1, there is shown a planar view of one form of the football launching apparatus 10 of the present invention. The apparatus includes a pneumatic cylinder 12 pivotably mounted to a frame 14. A piston 16 extending from one end of the cylinder 12 is coupled to an end of a shaft 18. The opposite end 20 of the shaft 18 includes a cupped shape receptacle 22 specifically conforming to the size and shape of one end of a football 24. A plurality of spiral threads 25 are formed on the outer surface of the shaft 18. The shaft 18 extends through a fixed, nut-like means 26 which is slidingly attached to another end of the frame 14. The nut means 26 includes a plurality of radially inner studs 28 (FIG. 2) which fit within the slots 30 defined between the spiral threads 25 on the shaft 18.

Figure 3:
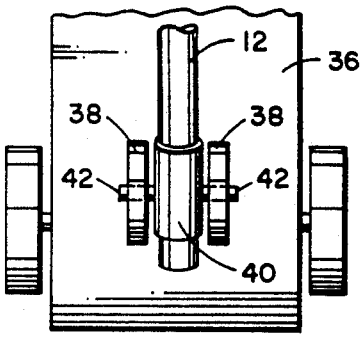
FIG. 3 is a plan view of a front section of the apparatus of FIG. 1.

The structure of the frame 14 may be of any suitable form for supporting the cylinder 12 and shaft 18. In one form, the frame is constructed of conventional 2"×2" angle iron. The undercarriage or truck 32 may use such angle iron to form a rectangular framework 34 and have at least a portion of the rectangular framework 34 overlaid with a metal plate 36. At an aft end of the truck 32, a pair of stanchions 38 are attached to plate 36 by welding, bolting or other conventional means. The stanchions 38 are spaced apart such that the cylinder 12 fits loosely between them. Referring to FIG. 3, the top plan view shows the spaced stanchions 38 with the cylinder 12 pivotably mounted. In one form, an outer shell 40 is welded to cylinder 12 and a pair of axle members 42 extend from shell 40 through corresponding bearing mounts in stanchions 38. Of course, other forms of pivotably attaching the cylinder 12 to stanchions 38 are known and could be used.

Figure 4:
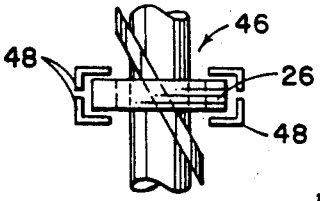
FIG. 4 is a plan view of the aft section of the apparatus of FIG. 1.

At an opposite end of frame 14 there is provided an upright support 44 for slidingly holding nut means 26. Again referring to FIG. 1 and considering the top plan view of FIG. 4, it can be seen that the nut means 26 is positioned within a cage 46 comprising four angle iron segments 48. Below the nut means 26 is a pneumatic cylinder 50 having a piston 52 attached to nut means 26.

Actuation of the cylinder 50 is effective to drive the nut means 26 vertically within the cage 46 and thereby to change or adjust the angular position of shaft 18 and cylinder 12. The cage 46 also includes angularly oriented side supports (not shown) extending between an upper part of the cage and the truck 32 in order to maintain the vertical orientation of the cage during actuation of the apparatus.

The pneumatic cylinders 12 and 50 are of a type well known in the art. Specifically, the cylinder 12 is a 24 inch long, 3 inch diameter cylinder which develops about 385 lbs. thrust at 120 psi. Air for both cylinders 12 and 50 is provided by a conventional air pump 54, either electric or gas powered, mounted on the truck 32. Air pressure is supplied to cylinders 12 and 50 via air hoses 56 and 58, respectively, through corresponding air control valves 60 and 62. The control valves 60,62 may be manual or electric solenoid operated. Valve 60 allows pressure to be applied to cylinder 12 and then released to retract piston 16. Alternately, cylinder 12 may be a conventional double acting cylinder and the valve 60 may switch air between ports on the cylinder to effect retraction of the piston. Valve 62 is a conventional control valve for maintaining predetermined pressure on cylinder 50 for holding nut means 26 in a preselected position.

Figure 2:
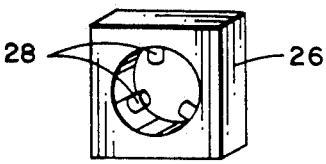
FIG. 2 is a perspective view of a spin inducing nut means used in the apparatus of FIG. 1.

While the threads 25 are shown at relatively shallow angles, it will be appreciated that the actual angles are significantly steeper. For example, for a shaft of 3" diameter and thread width of 1", the angle of the threads 25 with respect to a longitudinal axis 64 (coinciding with an initial arc of a trajectory 66 for launching football 24) is about 30°. As shown in FIG. 2, the shaft 18 fits within nut means 26 such that the studs 28 act on threads 25 to impart a rotation or spin to shaft 18 as it is driven through nut means 26. Clearly, the coupling between piston 16 and shaft 18 is of a type allowing such rotation of shaft 18. Conversely, the receptacle 22 is fixedly attached to shaft 18 so that the rotation of the shaft is transferred to the receptacle.

The receptacle 22 may be machined or formed from a stiff material, such as aluminum, or molded from a comparable plastic. The inside of receptacle 22 is formed to snugly support football 24 so that rotation of the cup is transferred to the ball. However, the fit is sufficiently loose that the football is relatively easily extracted from the receptacle enabling its launching when the receptacle is suddenly stopped at the end of travel of piston 16 and shaft 18.

In operation, the football 24 is positioned in the receptacle 22, which comprises means for holding the football, with the apparatus in the condition shown in FIG. 1. The launch angle is then selected by using the valve 62, to control air pressure to cylinder 50 and raise or lower the nut means 26. Once a launch angle and direction is selected, the valve 60 is opened, applying a sudden pressure to cylinder 12 causing it to drive shaft 18 through nut means 26. A spin is imparted to shaft 18 and transferred to ball 24 as shaft 18 is driven through nut means 26. The football 24 is accelerated to a selected launch velocity by control of the air pressure applied to cylinder 12. As is well known, the air pump 54 includes valves for setting a desired air pressure. When the piston and shaft reach their extended range of travel, typically about a 20" range, they are suddenly decelerated. The football 24, being releasably held in receptacle 22, continues outward at the final velocity reached by the receptacle 22 just prior to such deceleration. As noted, the acceleration of the football occurs over an initial arc of the desired trajectory of the ball (the initial arc portion being substantially a straight line). The spin imparted to the ball (a "spiral") causes it to track the trajectory. In tests using 120 psi on cylinder 12, routine "throws" of 70 or more yards are easily attained. Of course, some variation will occur between different types of cylinders 12 which may require slight adjustment of air pressure for comparable throws.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. Apparatus for launching a football on a predetermined trajectory comprising:

means for holding a football in an axial alignment such that each end of the football is substantially aligned on an initial arc of a predetermined trajectory;

means for rapidly accelerating said holding means along the predetermined trajectory for a preselected relatively small distance from a loading point to a release point;

means for effecting a relatively rapid spin of said holding means about an axis coincidental with said initial arc of the trajectory during acceleration over said relatively small distance said mean for effecting spin of said holding means is a tubular shaft having at least one continuous spiral thread formed on an outer surface thereof and a nut means positioned in axial alignment with said shaft, said nut means having radially inwardly projecting studs for interacting with thread on said shaft, and means for driving said shaft through said nut means for effecting spin of said shaft about a longitudinal axis thereof and means for affecting a release of the football from said holding means at said release point.

2. The apparatus of claim 1 wherein said holding means comprises a receptacle having an inner configuration substantially conforming to an outer configuration of an axial end of the football.

3. The apparatus of claim 1 wherein said accelerating means comprises a pneumatic cylinder attached to said shaft.

4. The apparatus of claim 3 wherein said longitudinal axis of said shaft is axially aligned with a longitudinal axis of said cylinder.

5. The apparatus of claim 4 and including an air pump for supplying air to said cylinder.

6. The apparatus of claim 5 and including a pneumatic valve operatively positioned in an air line between said air pump and said cylinder, said valve being selectively switched between open and closed positions for controlling actuation of said cylinder.

7. The apparatus of claim 6 wherein said frame is mounted on a wheeled truck.

8. The apparatus of claim 1 wherein said shaft is mounted within a frame and adjustable therein for changing said predetermined trajectory.

9. The apparatus of claim 8 wherein said frame is pivotable about a vertical axis for changing a direction of said trajectory.

* * * * *